US009035567B2

(12) United States Patent
Sakuragi et al.

(10) Patent No.: US 9,035,567 B2
(45) Date of Patent: May 19, 2015

(54) LIGHT-EMITTING DIODE DRIVING DEVICE FOR REDUCING LIGHT OFF PERIOD

(75) Inventors: Harumi Sakuragi, Tokushima (JP); Wataru Ogura, Okaya (JP); Minoru Kitahara, Okaya (JP)

(73) Assignee: NICHIA CORPORATION, Anan-shi (JP)

( * ) Notice: Subject to any disclaimer, the term of this patent is extended or adjusted under 35 U.S.C. 154(b) by 248 days.

(21) Appl. No.: 13/478,115

(22) Filed: May 23, 2012

(65) Prior Publication Data

US 2012/0299489 A1 Nov. 29, 2012

(30) Foreign Application Priority Data

May 24, 2011 (JP) ..... 2011-116390

(51) Int. Cl.
*H05B 37/02* (2006.01)
*H05B 33/08* (2006.01)

(52) U.S. Cl.
CPC ..... *H05B 33/083* (2013.01); *H05B 33/0809* (2013.01)

(58) Field of Classification Search
CPC ..... H05B 33/08; H05B 33/083; H05B 37/00; H05B 37/02; H05B 42/00
USPC ..... 315/291, 312, 185 S, 247
See application file for complete search history.

(56) References Cited

U.S. PATENT DOCUMENTS

| | | | | |
|---|---|---|---|---|
| 4,801,887 | A * | 1/1989 | Wegener | 363/126 |
| 2011/0084619 | A1 | 4/2011 | Gray et al. | |
| 2011/0199003 | A1* | 8/2011 | Muguruma et al. | 315/122 |
| 2011/0227489 | A1* | 9/2011 | Huynh | 315/185 R |

FOREIGN PATENT DOCUMENTS

| | | |
|---|---|---|
| JP | 50-109456 | 8/1975 |
| JP | 6-44352 | 6/1994 |
| JP | 2006-147933 | 6/2006 |
| JP | 2009-134933 | 6/2009 |
| JP | 2011-040701 | 2/2011 |
| JP | 2011-87298 | 4/2011 |

OTHER PUBLICATIONS

Japanese Office Action for corresponding JP Application No. 2011-116390, Feb. 3, 2015.

* cited by examiner

*Primary Examiner* — Douglas W Owens
*Assistant Examiner* — Henry Luong
(74) *Attorney, Agent, or Firm* — Mori & Ward, LLP

(57) ABSTRACT

An LED driving apparatus is provided. The apparatus includes an LED Portion 10, a charging/discharging capacitor 111, a capacitor charging and discharging paths, and a capacitor charging constant current portion 110. The LED driving portion 3 controls a current in the LED portion 10. The capacitor 111 is connected in parallel to the LED portion 10. The charging and discharging paths are connected to the capacitor whereby charging and discharging the capacitor, respectively. The constant current portion 110 is connected on the charging path and controls a charging current so that the capacitor is charged at a constant current. When rectified voltage applied to the LED portion becomes high, the capacitor is charged with the charging current through the charging path. When the voltage becomes low, the capacitor is discharged at a discharging current through the discharging path so that the discharging current is applied to the LED portion.

5 Claims, 10 Drawing Sheets

LIGHT-EMITTING DIODE DRIVING DEVICE FOR REDUCING LIGHT OFF PERIOD

BACKGROUND OF THE INVENTION

1. Field of the Invention

The present invention relates to a driving circuit which drives light-emitting diodes, and in particular to a light-emitting diode driving apparatus which drives light-emitting diodes by using AC power supply.

2. Description of the Related Art

In recent years, significant attention is given to light-emitting diodes (hereinafter, occasionally referred to as "LEDs") as lighting sources. The reason is that LEDs can be driven at low power consumption as compared with filament lamps or fluorescent lamps. LEDs are small, and have shock resistance. In addition, LEDs are less prone to blow out. Thus, LEDs have these advantages.

In the case of lighting sources, it is desirable that commercial AC power for home use is used as power supply for lighting sources. LEDs are devices driven by DC power. LEDs emit light only when applied with a current in the forward direction. Also, in the case of LEDs that are currently typically used for lighting use, the LEDs operate on DC power at a forward directional voltage $V_f$ of about 3.5 V. LEDs do not emit light if a voltage applied to the LEDs does not reach $V_f$. Conversely, a voltage applied to the LEDs exceeds $V_f$, an excessive amount of current will flow through the LEDs. Accordingly, it can be said that DC power is suitable for driving LEDs.

To satisfy the contradictory conditions, various types of LED driving circuits have been proposed that use AC power. For example, a method has been proposed that switches LEDs so that a $V_f$ total value is changed in accordance with a varying voltage value (see Japanese Patent Laid-Open Publication No. JP 2006-147,933 A). In this method, a number of LEDs connected to each other in series are divided into blocks 161, 162, 163, 164, 165 and 166 as shown in a circuit diagram of FIG. 6. The LED blocks 161 to 166 are selectively connected to the power supply in accordance with the voltage value of input voltage of rectified waveform by a switch control portion 167 consisting of a microcomputer so that a Vf total value is changed in a stepped manner. As a result, as shown by a voltage waveform in a timing chart of FIG. 7, since the LEDs can be driven by a plurality of rectangular waves corresponding to the rectified waveform, the LED usage efficiency can be improved as compared with the ON-duty in the case of only single rectangular wave.

On the other hand, the applicant has been developed an AC multi-stage circuit which includes a plurality of serially-connected LED blocks operated by an AC current after full-wave rectification, each of the plurality of LED blocks having a plurality of serially-connected LEDs (Japanese Patent Laid-Open Publication No. JP 2011-40,701 A).

As shown in FIG. 8, this AC multi-stage circuit subjects a current from an AC power supply AP to full-wave rectification in a bridge circuit 2 so that the LED blocks of multi stages are supplied with the current after the full-wave rectification. As the LED blocks of multi stages, first, second and third LED blocks 11, 12 and 13 are serially connected to each other. A first LED current control transistor 21A is turned ON/OFF to connect/disconnect a first bypass BP1 which bypasses the second LED block 12 based on the current amount in the first LED block 11. A second LED current control transistor 22A is turned ON/OFF to connect/disconnect a second bypass BP2 which bypasses the third LED block 13 based on the current amount in the first and second LED blocks 11 and 12.

This AC multi-stage circuit can keep power supply efficiency high, and additionally improve the LED usage efficiency and the power factor.

The applicant has been developed a light-emitting diode driving apparatus which includes a plurality of LEDs connected to each other and can suppress harmonic components as shown in FIG. 9. FIG. 10 is a graph showing a current waveform obtained by this light-emitting diode driving apparatus. Thus, harmonic distortion can be suppressed so that the LEDs can be driven by a current with the current waveform close to sine wave.

On the other hand, in the case where conventional filament lamps are used as light emitting elements instead of LEDs, a current flowing in the filament lamps will also have a substantially sine waveform. In the case of filament lamps, since light produced as incandescence from filament, the light does not fluctuate at power supply frequency (50 Hz or 60 Hz), in other words, flicker does not occur. Contrary to this, in the case where LEDs are used as light emitting elements, since LEDs have high responsivity, there is a problem that flicker will occur at the power supply frequency. This can be seen from a light output waveform of a sine wave multi-stage driving circuit shown in FIG. 11. The crest factor (=maximum value/effective value) is used as objective index, and gets better as it gets closer to 1 (one). The calculated crest factor of this light output shown in FIG. 11 is not smaller than 1.5. This value is worse than filament lamp of about 1.05, fluorescent lamp of about 1.36, and inverted fluorescent lamp of about 1.1. This means that some people may perceive flicker. In case where the LEDs are lighting a rotating body, if the power supply frequency matches with the rotating frequency, it may perceived that the rotating body is stopped even though it rotates. Accordingly, these may cause poor lighting quality. For this reason, if the light-emitting diode driving apparatus shown in FIG. 9 is used for high quality lighting, it is necessary to eliminate the light OFF period and to improve its crest factor.

It can be conceived that a capacitor is used for smoothing to eliminate flicker. That is, it can be conceived that the capacitor is charged in the period where a power supply voltage is high, and is discharged in the period where the voltage is low. However, if a capacitor is used, the capacitor will be rapidly charged in a short charging period, which in turn increases the charging current. In addition, the charging current will be increased with the capacity of the capacitor. In the case of a large capacitor to be used for such smoothing, the charging current will be further increased, which in turn deteriorates the power factor. For this reason, such a light-emitting diode driving apparatus may not meet the harmonic distortion standards. On the other hand, it can be conceived that an active filter IC is additionally used to improve the power factor. However, there are disadvantages that such an element is expensive, and that high frequency switching noise may be produced.

The present invention is devised to solve the above problems. It is a main object of the present invention is to provide a light-emitting diode driving apparatus which can improve its crest factor by reducing the light OFF period without distorting an input current waveform approximating a sine wave.

SUMMARY OF THE INVENTION

To achieve the above object, a light-emitting diode driving apparatus according a first aspect of the present invention includes a rectifying circuit 2, an LED portion 10, an LED driving portion 3, a charging/discharging capacitor 111, a capacitor charging path, a capacitor discharging path, and a capacitor charging constant current portion 110. The rectifying circuit 2 can be connected to AC power supply AP and rectifies an AC voltage of the AC power supply AP to provide a rectified voltage. The LED portion 10 includes first and second LED sections 11 and 12 serially connected to the output side of the rectifying circuit 2. Each of the first and second LED sections 11 and 12 includes at least one LED device. The LED driving portion 3 controls a current flowing in the LED portion 10. The charging/discharging capacitor 111 is connected in parallel to the LED portion 10. The capacitor charging path is connected to the charging/discharging capacitor whereby charging the charging/discharging capacitor. The capacitor discharging path is connected to the charging/discharging capacitor whereby discharging the charging/discharging capacitor. The capacitor charging constant current portion 110 is connected on the capacitor charging path and controls a capacitor charging current so that the charging/discharging capacitor is charged at a constant current. When the rectified voltage applied to the LED portion becomes high, the charging/discharging capacitor is charged with the charging current through the charging path. When the rectified voltage applied to the LED portion becomes low, the charging/discharging capacitor is discharged at a discharging current through the discharging path so that the discharging current is applied to the LED portion. According to this construction, the charging/discharging capacitor is used to be charged when the rectified voltage applied to the LED portion becomes high so that the charged electric charge is discharged to apply a current to the LED portion when the rectified voltage becomes low. As a result, it is possible to reduce the difference of the current amount in the LED portion. Therefore, it is possible to improve the crest factor. In addition, since the capacitor charging constant current portion is connected on the charging path, an inrush current into the charging/discharging capacitor can be suppressed. Therefore, it is possible to prevent power factor reduction.

In a light-emitting diode driving apparatus according a second aspect of the present invention, a charging diode 116 and a discharging diode 117 can be further provided. The charging diode 116 is connected on the capacitor charging path, and allows the charging current to flow whereby charging the charging/discharging capacitor. The discharging diode 117 is connected on the capacitor discharging path, and allows the discharging current to flow whereby discharging the charging/discharging capacitor. According to this construction, charging current and discharging current can flow on the charging path and the discharging path, respectively, in the proper direction so that the charging/discharging capacitor can be properly charged/discharged. Therefore, a light-emitting diode driving apparatus can stably operate.

In a light-emitting diode driving apparatus according a third aspect of the present invention, the capacitor charging constant current portion 110 can include a plurality of transistors.

In a light-emitting diode driving apparatus according a fourth aspect of the present invention, a third LED portion 13 can be further provided which includes at least one LED device serially connected to the second LED section 12.

In a light-emitting diode driving apparatus according a fifth aspect of the present invention, a first portion 21, a second portion 22, a fourth portion 24, a first current control portion 31, a second current control portion 32, a fourth current control portion 34, and a current detection portion 4 can be provided. The first portion 21 is connected in parallel to the second LED section 12, and controls the flowing current amount in the first LED section 11. The second portion 22 is connected in parallel to the third LED section 13, and controls the flowing current amount in the first and second LED sections 11 and 12. The fourth portion 24 is connected serially to the third LED section 13, and controls the flowing current amount in the first, second and third LED sections 11, 12 and 13. The first current control portion 31 controls the first portion 21. The second current control portion 32 controls the second portion 22. The fourth current control portion 34 controls the fourth portion 24. The current detection portion 4 detects a current detection signal based on the amount of a current flowing in on an output line OL serially connected from the first LED section 11 to the third LED section 13.

In a light-emitting diode driving apparatus according a sixth aspect of the present invention, a harmonic suppression signal generation portion 6 can be further provided that provides a harmonic suppression signal voltage based on the rectified voltage provided from the rectifying circuit 2. The first, second and fourth current control portions 31, 32 and 34 compare the current detection signal detected by the current detection portion 4 with the harmonic suppression signal voltage provided by the harmonic suppression signal providing portion 6, and control the first, second and fourth portions 21, 22 and 24 based on the comparison result whereby suppressing harmonic components. According to this construction, the output waveform can be adjusted/controlled based on the comparison result between the input-side harmonic component and the obtained LED driving current. Therefore, it is possible to effectively suppress harmonic components.

In a light-emitting diode driving apparatus according a seventh aspect of the present invention, a fourth LED portion 14, a third portion 23, and a third current control portion 33 can be further provided. The fourth LED portion 14 includes at least one LED device serially connected to the third LED portion 13. The third portion 23 is connected in parallel to the fourth LED portion 14, and controls the flowing current amount in the first, second and third LED portions 11, 12 and 13. The third current control portion 33 controls the third portion 23. The fourth portion 24 controls the flowing current amount in first, second, third and fourth LED portions 11, 12, 13 and 14. According to this construction, the capacitor is charged in the period where the rectified voltage is high, and is discharged in the period where the rectified voltage is low so that the LED portion emits light. As a result, the light OFF period of the LED portion can be eliminated. Therefore, it is possible to improve the crest factor. In addition, the light-emitting diode driving apparatus can operate without affecting the harmonic distortion suppression of the light-emitting diode driving apparatus and with keeping the power factor high.

The above and further objects of the present invention as well as the features thereof will become more apparent from the following detailed description to be made in conjunction with the accompanying drawings.

DETAILED DESCRIPTION OF THE EMBODIMENT(S)

Figure 1:
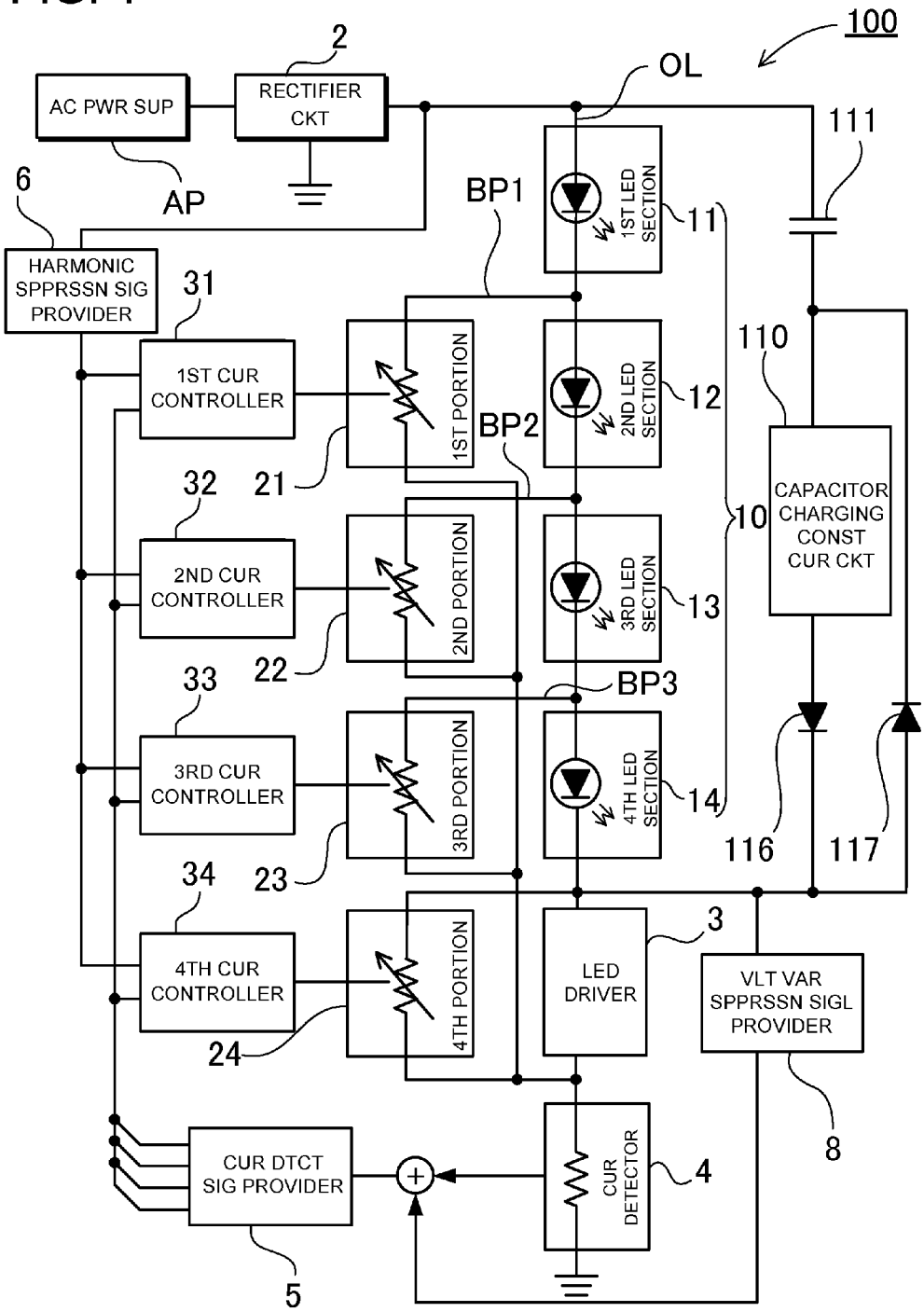
FIG. 1 is a block diagram showing a light-emitting diode driving apparatus according to a first embodiment.

The following description will describe an embodiment according to the present invention with reference to the drawings. It should be appreciated, however, that the embodiments described below are illustrations of a light-emitting diode driving apparatus used therein to give a concrete form to technical ideas of the invention, and a light-emitting diode driving apparatus of the invention is not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown larger exaggeratingly for ease of explanation. Members same as or similar to those of this invention are attached with the same designation and the same reference numerals, and their description is omitted. In addition, a plurality of structural elements of the present invention may be configured as a single part that serves the purpose of a plurality of elements, on the other hand, a single structural element may be configured as a plurality of parts that serve the purpose of a single element. Also, the description of some of examples or embodiments may be applied to other examples, embodiments or the like.

In order that a light-emitting diode driving apparatus may meet the harmonic current standards, it is desired to flow a current having a current waveform of sine wave similar to filament lamps. According to the light-emitting diode driving apparatuses of embodiments of the present invention, a sine wave is superimposed on the reference voltage of an LED current control portion so that the waveform of LED driving current is brought to a waveform approximating a sine wave. Thus, the light-emitting diode driving apparatus can be provided which is inexpensive and compact, and meets the harmonic current standards for apparatuses of not smaller than 25 W.

First Embodiment

FIG. 1 is a block diagram showing a light-emitting diode driving apparatus 100 according to a first embodiment. The light-emitting diode driving apparatus 100 includes a rectifying circuit 2, an LED portion 10, first to fourth portions 21 to 24, first to third current control portions 31 to 33, and a current detection portion 4. In the light-emitting diode driving apparatus 100, the rectifying circuit 2, and the LED portion 10 are serially connected to each other through an output line OL. The rectifying circuit 2 is connected to AC power supply AP, and obtains a rectified voltage (pulsating voltage) by rectifying an AC voltage. The LED portion 10 includes a plurality of LED portions. In this embodiment, four LED sections are used as first, second, third and fourth LED sections 11, 12, 13 and 14, which are serially connected to each other. Thus, the first to fourth LED sections compose the LED portion 10. In addition, the LED portion 10, a LED driving portion 3, and a current detection portion 4 are serially connected to each other through the output line OL.

A first portion 21, a second portion 22, and a third portion 23 are connected to the second LED section 12, the third LED section 13, and the fourth LED section 14. Each of the first to third portions is connected to the both ends of corresponding one of the second to fourth LED sections to control the flowing current amount in each of the second to fourth LED sections. Each of the first, second and third portions 21, 22 and 23 is thus connected in parallel to corresponding one of the LED sections. Accordingly, each of the first to third portions serves as a bypass path that adjusts the flowing current amount in the LED section(s). In other words, each of the first, second and third portions 21, 22 and 23 can adjust the amount of a bypassed current, which in turn can control the flowing current amount in the LED section(s). In the case of FIG. 1, the first portion 21 is connected in parallel to the second LED section 12, and serves as the first bypass path BP1. Also, the second portion 22 is connected in parallel to the third LED section 13, and serves as a second bypass path BP2. Also, the third portion 23 is connected in parallel to the fourth LED section 14, and serves as a third bypass path BP3. An output current can flow also in the bypass paths which bypass the LED section(s) and the like, which is/are connected to the output line. From this viewpoint, the output line can include the bypass paths in this specification.

(Current Control Portion)

Current control portions for controlling a constant current circuit are provided to drive LED devices at a constant current. In this exemplary circuit, the first, second, third and fourth portions 21, 22, 23 and 24, and the first, second, third and fourth current control portions 31, 32, 33 and 34 compose a sort of constant current circuit.

Each of the current control portions is connected to corresponding one of the first, second, third and fourth portions 21, 22, 23 and 24, and controls ON/OFF operation and flowing current amount continuously-varying operation of corresponding one of the first, second, third and fourth portions 21, 22, 23 and 24. Specifically, the first current control portion 31 controls operation of the first portion 21. The second current control portion 32 controls operation of the second portion 22. The third current control portion 33 controls operation of the third portion 23. The fourth current control portion 34 controls operation of the fourth portion 24. The first, second, third and fourth control portions 31, 32, 33 and 34 are connected to the current detection portion 4 so that the LED current amount is monitored. The first, second, third and fourth current control portions 31, 32, 33 and 34 control operation property of the first, second, third and fourth portions 21, 22, 23 and 24, respectively, based on the LED current amount values.

Each LED section includes one LED device or a plurality of LED devices which are connected to each other in series and/or in parallel. Surface-mount type LEDs (SMDs) or bullet type LEDs can be suitably used for the LED devices. SMD type LED devices can have packages with various external shapes, such as a rectangular shape in plan view, depending on applications. Needless to say, a plurality of LED devices can be connected to each other in series and/or in parallel inside an LED package as the LED section.

A subtotal forward directional voltage of LED devices which are included in this LED section is defined by the sum of the forward directional voltages of LED devices which are included in this LED section. The subtotal forward directional voltage is determined by the number of the LED devices which are connected to each other in series in this LED section. For example, in the case where six LED devices are employed that have a forward directional voltage of 3.6 V, the subtotal forward directional voltage of the six LED devices will be 3.6×6=21.6 V.

The light-emitting diode driving apparatus 100 switches ON/(constant current control)/OFF of each LED section based on a current value detected by the current detecting portion 4. In other words, a current is controlled not based on the voltage value of rectified voltage but based on the amount of an actually-flowing current. For this reason, ON/(constant current control)/OFF of the LED sections can be accurately switched at appropriate timing irrespective of deviation of the forward directional voltages of LED devices. Therefore, reliable and stable operation can be expected. The current value can be detected by the current detection portion 4, or the like.

In the case of FIG. 1, the first current control portion 31 controls the restriction amount on a flowing current in the first LED section 11 controlled by the first portion 21 based on the flowing current amount in the first LED section 11. Specifically, in the case where the first, second and third fourth portions 21, 22, 23 and 24 are in ON, when the flowing current amount reaches a predetermined first threshold current value, the first portion 21 drives the first LED section 11 at a constant current. Subsequently, the input voltage will rise. When the input voltage reaches a voltage which can drive the first and second LED sections 11 and 12 together, a current starts flowing into the second LED section 12. Subsequently, when a current exceeds the first threshold current value, the first portion 21 is turned OFF. Also, the second current control portion 32 controls the flowing current limit value for the first and second LED sections 11 and 12 through the second portion 22 based on the flowing current amount in the first and second LED 11 and 12. Specifically, when the flowing current amount reaches a predetermined second threshold current value, the second portion 22 drives the first and second LED sections 11 and 12 at a constant current. Subsequently, the input voltage will rise. When the input voltage reaches a voltage which can drive the first, second and third LED sections 11, 12 and 13 together, a current starts flowing into the third LED section 13. Subsequently, when a current exceeds the second threshold current value, the second portion 22 is turned OFF.

Also, the third current control portion 33 controls the flowing current limit value for the first, second and third LED sections 11, 12 and 13 through the third portion 23 based on the flowing current amount in the first, second and third LED sections 11, 12 and 13. Specifically, when the flowing current amount reaches a predetermined third threshold current value, the third portion 23 drives the first, second and third LED sections 11, 12 and 13 at a constant current. Subsequently, the input voltage will rise. When the input voltage reaches a voltage which can drive the first, second, third and fourth LED sections 11, 12, 13 and 14 together, a current starts flowing into the fourth LED section 14. Subsequently, when a current exceeds the third threshold current value, the third portion 23 is turned OFF. Finally, the fourth portion 24 and the fourth current control portion 34 drive the first, second, third and fourth LED sections 11, 12, 13 and 14 at a constant current.

In the case where the threshold current values are specified first threshold current value<second threshold current value<third threshold current value, the first, second, third and fourth LED sections 11, 12, 13 and 14 can be turned ON/(constant current control)/OFF in this order. It should be noted that these threshold current can be adjusted freely by controlling an input signal to one of the input terminal of the current control portions 31-34. For example, if sinusoidal voltage is input into the input terminal, then current control corresponding to sine wave is achieved, which is discussed later.

The light-emitting diode driving apparatus 100 using AC power AP such as commercial power for home use includes a plurality of constant current circuits that drive serially-connected LED devices in accordance with a periodically-varying pulsating voltage that is obtained after an alternating current is subjected to full-wave rectification. Thus, the constant current circuits can be appropriately driven by the LED current detecting circuits.

The light-emitting diode driving apparatus 100 applies a first current value to the first LED section 11, a second current value larger than the first current value to the first and second LED sections 11 and 12, a third current value larger than the second current value to the first, second and third LED sections 11, 12 and 13, and a fourth current value larger than the third current value to the first, second, third and fourth LED sections 11, 12, 13 and 14. In particular, since a flowing current amount in the LED section(s) is controlled in a constant current control manner, the LED section can be turned ON/(constant current control)/OFF in accordance with the flowing current amount. Therefore, the LEDs can be efficiently driven by a pulsating voltage.

In the case of FIG. 1, the LED driving portion 3 is connected in parallel to the fourth portion 24 so that a current, which will flow in the fourth portion 24, can be partially branched also into the LED driving portion 3. Thus, the LED driving portion 3 can reduce the load of the fourth portion 24.

(Harmonic Suppression Signal Providing Portion 6)

The first to fourth control portions 31 to 34 are connected to the harmonic suppression signal providing portion 6. The harmonic suppression signal generation portion 6 provides a harmonic suppression signal voltage based on the rectified voltage provided from the rectifying circuit 2. The harmonic suppression signal providing portion 6 reduces a rectified voltage rectified by the rectifying circuit 2 at a certain ratio, and provides the reduced voltage as reference signal to the first to fourth current control portions 31 to 34 so that an LED current detection signal is compared with the reference signal. The current control portions drive the LED sections at suitable timing and suitable currents based on the comparison result by using the first to fourth portions 21 to 24.

(Smoothing Circuit)

The light-emitting diode driving apparatus shown in FIG. 1 additionally includes a smoothing circuit for reducing the LED light OFF period. The smoothing circuit includes a capacitor 111, a capacitor charging constant current portion 110, a charging diode 116, and a discharging diode 117.

(Capacitor Charging Circuit)

The capacitor charging constant current circuit 110 adjusts a capacitor charging current to a constant current smaller than the sine wave current for driving the LEDs provided by the first to fourth current control portions 31 to 34. The capacitor charging current and the LED driving current are superimposed so that the superimposed current is then adjusted to a sine wave current by the first to fourth current control portions 31 to 34. Thus, the capacitor can be charged without affecting the entire current of the light-emitting diode driving apparatus, which is controlled by a current waveform approximating to the original sine wave.

(Capacitor Discharging Circuit)

The discharging circuit for discharging the capacitor 111 is connected through the discharging diode 117 to the LED portion 10 of the serially-connected first to fourth LED sections 11 to 14. The electric charge stored in the capacitor 111 is discharged not through the capacitor charging constant current circuit 110, the charging diode 116 and the like, but through the capacitor discharging circuit. Since the charged voltage of the capacitor 111 will be the sum of the Vf values of the serially-connected first to fourth LED sections, which compose the LED portion 10, the capacitor 111 will not be discharged at a current larger than a current which flows in the LED portion 10 when the capacitor is charged.

(Exemplary Circuit According to First Embodiment)

Figure 2:
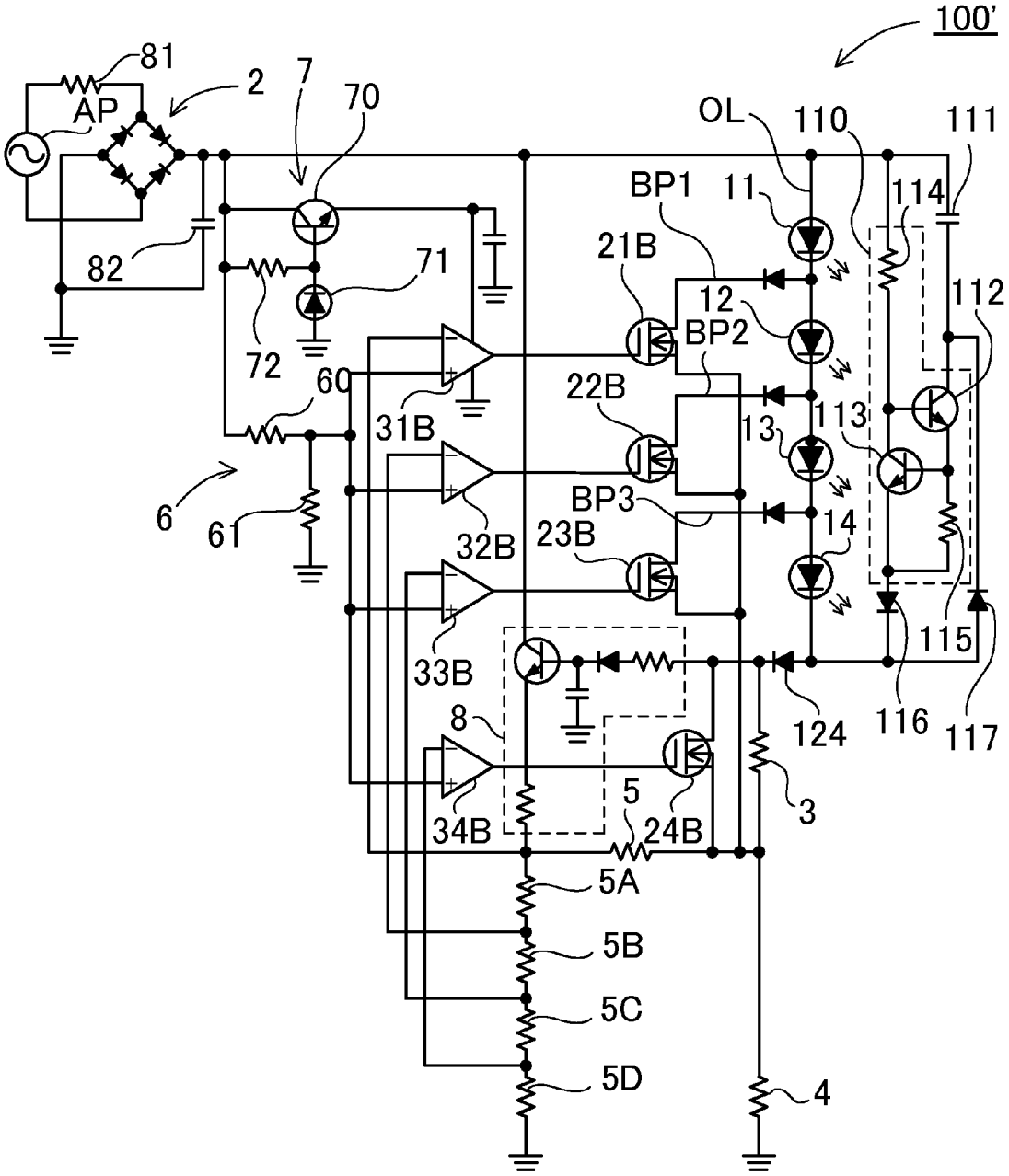
FIG. 2 is a circuit diagram showing an exemplary circuit of the light-emitting diode driving apparatus shown in FIG. 1.

FIG. 2 shows an exemplary circuit of the light-emitting diode driving apparatus 100 shown in FIG. 1, which includes semiconductor devices. In a light-emitting diode driving apparatus 100', a diode bridge is used as the rectifying circuit 2 connected to the AC power supply AP. A protection resistor 81 is connected between the AC power supply AP and the rectifying circuit 2. A bypass capacitor 82 is connected to an output side of the rectifying circuit 2. In addition, although not illustrated, a fuse or a surge protection circuit for preventing an over-current flow or surge voltage can be connected between the AC power supply AP and the rectifying circuit 2.

(AC Power Supply AP)

The 100-V or 200-V commercial power can be suitably used as the AC power supply AP. The voltage 100 or 200 V in this commercial power is an effective value. The maximum voltage of a rectified waveform subjected to full-wave rectification will be about 141 or 282 V.

(LED Portion 10)

A plurality of LEDs are divided into a plurality of LED blocks as LED sections which compose the LED portion 10. The LED blocks are connected to each other in series. Terminals are provided between the blocks, and are connected to the first, second, third and fourth portions 21, 22, 23 and 24. The LED portion 10 is composed of four groups as the first, second, third and fourth LED sections 11, 12, 13 and 14 in the case of FIG. 2.

In FIG. 2, each of the LED sections 11 to 14 is shown by a single LED symbol, which represents an LED package 1 including a plurality of LED chips. In this embodiment, each LED package 1 includes ten LED chips. The number of light-emitting diodes to be connected to each other in each LED section or the number of the LED sections to be connected to each other can be determined by the sum of forward directional voltages (i.e., the number of the LED devices connected to each other in series) and the voltage of power supply to be used. For example, in the case where the commercial power is used, a total forward directional voltage $V_{fall}$ as the sum of Vf values of the LEDs of the LED sections is adjusted to about 141 V or not more than 141 V.

Each LED section can include an arbitrary number of LED devices (at least one LED). The LED device can be a single LED chip, or a single package including a plurality of collectively-arranged LED chips. In this embodiment, each of the illustrated LED symbols is the LED package 1 which includes ten LED chips.

The four LED sections have the same Vf value in the case of FIG. 2. However, the number of LED sections is not limited to this. The number of LED sections can be three or less, or five or more so that these LED sections have the same Vf value similarly. In the case where the number of LED sections is increased, the number of constant currents is increased which is applied to the LED sections in constant current control. In this case, the LED section switching transition can be smoother. Alternatively, the Vf values of LED sections may not be the same.

(First to Fourth Portions 21 to 24)

Each of the first, second, third and fourth portions 21, 22, 23 and 24 drive the LED section(s) at a constant current. The first to fourth portions 21 to 24 are composed of switching devices such as transistors. In particular, FETs are preferable. The reason is that saturation voltage between source and drain of FET is substantially zero, and will not reduce a flowing current amount in the LED section. However, needless to say, the first to fourth portions 21 to 24 are not limited to FETs but can be composed of bipolar transistors or the like.

In the case of FIG. 2, LED current control transistors are used as the first to fourth portions 21 to 24. Specifically, the second LED section 12 is connected in parallel to a first LED current control transistor 21B. Also, the third LED section 13 is connected in parallel to a second LED current control transistor 22B. Also, the fourth LED section 14 is connected in parallel to a third LED current control transistor 23B. Also, the LED driving portion 3 is connected in parallel to a fourth LED current control transistor 24B. The first to fourth LED current control transistors 21B to 24B serve as the first to fourth portions 21 to 24, respectively. Each of the LED current control transistors is switched between ON/OFF state and constant current control in accordance with the current amount in the LED section(s) previous to the corresponding one of the LED sections and the LED driving portion, which is connected in parallel to this LED current control transistor. When the LED current control transistor is turned OFF, the current will not flow in the bypass path so that the current starts flowing the corresponding LED section. In other words, each of the first to fourth portions 21 to 24 can adjust the amount of a bypassed current, which in turn can control the flowing current amount in the LED section(s) previous to the corresponding one of the LED sections and the LED driving portion. In the case of FIG. 2, the first portion 21 is connected in parallel to the second LED section 12, and serves as the first bypass path BP1. Also, the second portion 22 is connected in parallel to the third LED section 13, and serves as the second bypass path BP2. Also, the third portion 23 is connected in parallel to the fourth LED section 14, and serves as the third bypass path BP3. Also, the fourth LED current control transistor 24B is connected, and can control the flowing current amount in the first, second, third and fourth LED sections 11, 12, 13 and 14.

The first LED section 11 is connected in parallel to neither the bypass paths nor the first to fourth portions. The reason is that the flowing current amount in the first LED section 11 can be controlled by the first portion 21, which is connected in parallel to the second LED section 12. Also, the flowing current amount in the fourth LED section 14 can be controlled by the fourth LED current control transistor 24B.

In the case of FIG. 2, a resistor 3 is used as the LED driving portion 3. In this case, since the LED driving portion 3 is connected in parallel to the fourth portion of the transistor, a current can be bypassed if the amount of the current becomes large. Therefore, it is possible to reduce the load of the fourth portion. However, the LED driving portion 3 may be omitted.

In the case of FIG. 2, FETs are used as the LED current control transistors. In the case where the ON/OFF switching operation is controlled one by one by means of the first, second, third and fourth LED current control transistors 21B, 22B, 23B and 24B, the control semiconductor device such as FET, which composes each LED current control transistor, is connected between the both ends of each LED section. Accordingly, the control semiconductor device is protected from exceeding its breakdown voltage by the subtotal forward directional voltage of each LED section. For this reason, advantageously, low-breakdown voltage, small semiconductor elements can be employed.

(First, Second, Third and Fourth Current Control Portions 31, 32, 33 and 34)

The first, second, third and fourth current control portions 31, 32, 33 and 34 control the first to fourth portions 21 to 24 so that the first to fourth portions 21 to 24 drive the corresponding LED sections at a constant current at appropriate timing. Switching elements such as transistors can be used as the first to fourth current control portions 31 to 34. In particular, bipolar transistors can be suitably employed to detect a current amount. In this embodiment, the first, second, third and fourth current control portions 31, 32, 33 and 34 are composed of operational amplifiers. However, needless to say, the current control portion is not limited to operational amplifiers, but can be composed of comparators, bipolar transistors, MOSFETs, or the like.

In the case of FIG. 2, the current control portions control operation of the LED current control transistors. In other words, each of the operational amplifiers is switched ON/(constant current control)/OFF so that corresponding one of the LED current control transistors is switched to ON/(constant current control)/OFF.

(Current Detection Portion 4)

The current detection portion 4 detects a flowing current in the LED portion 10 composed of serially-connected LED sections based on voltage drop or the like. Thus, LED devices which compose LED sections are driven at a constant current. The current detection portion 4 also serves as protection resistors for protecting LEDs. Current control portions for controlling a constant current circuit are provided to drive LED sections at a constant current. In this exemplary circuit, the first, second, third and fourth portions 21, 22, 23 and 24, and the first, second, third and fourth current control portions 31, 32, 33 and 34 compose a sort of constant current circuit.

The resistances of the LED current detection resistors specify the ON/OFF timing of the current control portions, in other words, determine the current amounts at which the current control portions are turned ON/OFF. In this embodiment, the resistances of the LED current detection resistors are previously set which turn the first to fourth current control portions 31 to 34 of operational amplifiers ON one by one in this order.

(Threshold Current Value)

The first current control portion 31B switches the first LED current control transistor 21B from ON to OFF at a first threshold current value. The second current control portion 32B switches the second LED current control transistor 22B from ON to OFF at a second threshold current value. In this embodiment, the first threshold current value is smaller than the second threshold current value. Also, the third current control portion 33B switches the third LED current control transistor 23B from ON to OFF at a third threshold current value. The third threshold current value is greater than the second threshold current value. Also, the fourth current control portion 34B switches the fourth LED current control transistor 24B from ON to OFF at a fourth threshold current value. The fourth threshold current value is greater than the third threshold current value. In the case where the threshold current values are specified first threshold current value<second threshold current value<third threshold current value<fourth threshold current value, as the input voltage rises which is rectified by the rectifying circuit 2, the first, second, third and fourth LED sections 11, 12, 13 and 14 can be turned to ON/constant current control from OFF in this order. On the other hand, as the input voltage decreases, the LED sections are turned OFF in the inverse order.

(Operation of Harmonic Suppression Signal Providing Portion 6)

With reference to FIG. 2, the operation of the harmonic suppression signal providing portion 6 is now described in the light-emitting diode driving apparatus 100'. In the exemplary circuit of FIG. 2, the current control portions are composed of the operational amplifiers 31B to 34B. The operational amplifiers 31B to 34B are controlled by the harmonic suppression signal providing portion 6.

Specifically, the operational amplifiers 31B to 34B are driven by a constant voltage power supply 7. The constant voltage power supply 7 includes an operational amplifier power supply transistor 70, a zener diode 71, and a zener voltage setting resistor 72. The constant voltage power supply 7 supplies power to the operational amplifiers 31B to 34B only during the period which the zener voltage of the zener diode 71 is lower than the rectified voltage after the rectifying circuit 2 rectifies the current from the AC power supply AP. This period is previously set so as to include the LED ON period. That is, the operational amplifier operates during the LED ON period, and controls the LED ON states.

The harmonic suppression signal providing portion 6 includes harmonic suppression signal providing resistors 60 and 61. The harmonic suppression signal generation resistance 60 and 61 divides the rectified voltage, which is rectified by the rectifying circuit 2. In other words, the harmonic suppression signal providing portion 6 reduces the rectified voltage at a certain ratio. The positive-side input terminal of each operational amplifier is provided with a harmonic suppression signal, which is a reduced sine wave provided from the side where the harmonic suppression signal providing resistors 60 and 61 are connected.

On the other hand, the negative-side input terminals of the operational amplifiers are provided with voltages which are detected by current detection resistor equipment. A voltage of the current detection resistor 4 is specified so that the operational amplifiers serve to control a current in correspondingly predetermined periods, in other words, so that a current can be controlled in accordance with a sine wave applied to the positive-side input terminals of the operational amplifiers. Thus, positive-side input terminals of the operational amplifiers can be provided with a sine wave of pulsating current, which is rectified by the rectifying circuit 2. Since the LED driving current can be controlled in accordance with a sine wave of pulsating current, the LED driving current can have a shape approximated to the sine wave.

Each LED section can be composed of a plurality of light-emitting diode devices connected to each other in series. Accordingly, a rectified voltage can be effectively divided by the light-emitting diode devices. In addition, the light-emitting diode devices can smooth out a certain deviation of forward directional voltages $V_f$ and the temperature characteristics of light-emitting diode devices. The number of LED sections, the number of light-emitting diode devices composing each LED section and the like can be suitably adjusted depending on required brightness, supplied voltage and the like. For example, an LED section can consist of one light-emitting diode device. The number of LED sections can be increased so that the LED section switching transition is smoother. Conversely, the number of LED sections can be two for simple control.

Although it has been described that the number of LED sections is four in the aforementioned configuration, needless to say, the number of LED sections can also be two or three, or five or more. In particular, in the case where the number of LED sections is increased, the current waveform can be controlled so as to have a smoother stepped shape. Accordingly, it is possible to further suppress harmonic components. Although the LED sections are turned ON/OFF one by one every when the input current reaches predetermined values the differences of which are substantially constant in the case of FIG. 1, the differences of the predetermined values are not limited to constant. The LED sections may be turned ON/OFF one by one every when the input current reaches predetermined values the differences of which are not constant.

Although the LEDs are distributed in the four LED sections each of which has the same $V_f$ value in the foregoing embodiment, the LED sections are not required to have the same $V_f$ value. For example, if the $V_f$ value of the first LED section is reduced as lower as possible, in other words, if the $V_f$ value of the first LED section is set about 3.6 V, which corresponds to the $V_f$ value of a single LED, the leading edge of the current can be closer to the rise timing of the sine wave from zero while the trailing edge of the current can be closer to the decay timing of the sine wave to zero. In this case, it is more advantageous to reduce harmonic components. In the case where the number and the $V_f$ values of the LED sections are suitably selected, the current waveform can more closely approximate the sine wave. Such flexibility can more easily provide harmonic suppression.

Figure 8:
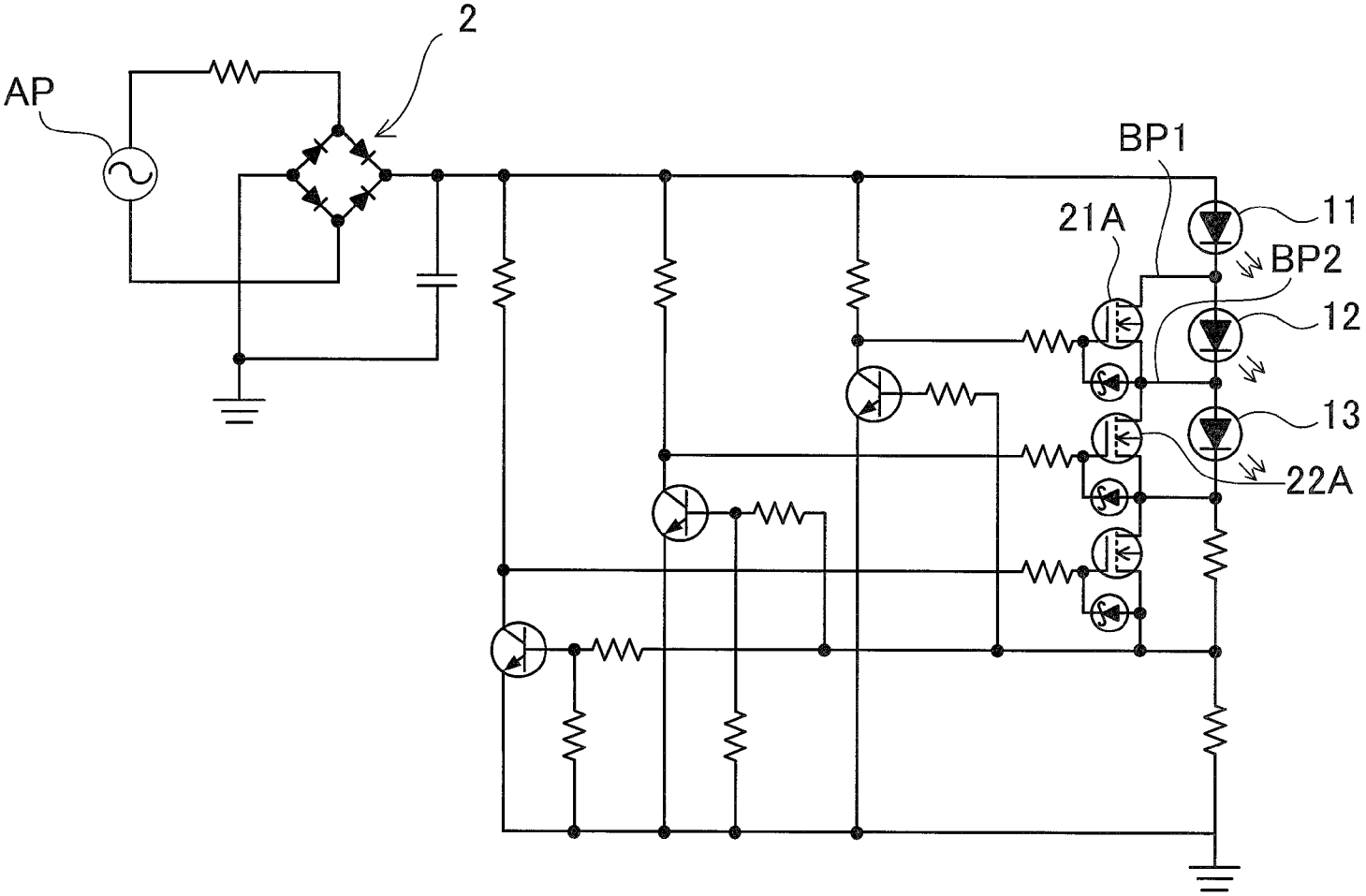
FIG. 8 PRIOR ART
FIG. 8 is a circuit diagram showing a light-emitting diode driving apparatus which has been developed by the applicant.

The minimum voltage difference between the negative-side input terminals of adjacent operational amplifiers can be set to any value not lower than the offset voltage of the operational amplifier, for example, can be set to about several millivolts. This is advantageous for circuit designing. For example, if the current control portions are composed of transistors as in the case of an AC multi-stage circuit shown in FIG. 8, the minimum voltage difference is necessarily set not smaller than several tens mV from viewpoint of setting current variation due to temperature difference between positions on a circuit board on which the semiconductor parts are mounted. Contrary to this, the minimum voltage difference in the exemplary circuit according to the first embodiment can be set a value about a tenth of the voltage difference of the construction where the current control portions are composed of transistors. In the construction according to the first embodiment, LED section currents can be minutely set. In addition, the number of LED sections or the like can be flexibly increased. As a result, the waveform can more closely approximate the sine wave. From this reason, the construction according to the first embodiment has such an advantage even if the trade-off for improvement in approximation is some increase in parts cost or the like.

(Current Detection Signal Providing Portion 5)

As shown in FIG. 1, the current detection signal providing portion 5 distributes the current detection signal detected by the current detection portion 4, and provides the distributed signals to the first, second, third and fourth current control portions 31, 32, 33 and 34. In the exemplary circuit of FIG. 2, the current detection signal providing portion 5 corresponds to current detection signal providing resistors 5A to 5D.

(Voltage Variation Suppression Signal Providing Portion 8)

In the light-emitting diode driving apparatus according to the present invention, a voltage variation suppression signal providing portion 8 can be additionally provided which produces the voltage variation suppression signal, and provide the voltage variation suppression signal to the current detection signal providing portion 5. In FIG. 2, the voltage variation suppression signal generation portion 8 is shown by the area enclosed by the dashed line. The voltage variation suppression signal generation portion 8 integrates the voltage variation suppression signal, and then adds the integrated signal to the current detection signal. According to this construction, although the pulsating voltage varies, the current variation can be suppressed.

(Capacitor Charging Constant Current Circuit 110)

In the light-emitting diode driving apparatus shown in FIG. 2, the capacitor charging constant current circuit 110 includes a charging current control transistor 112, a charging current detection control transistor 113, a charging current detection resistor 115, and a collector resistor 114. The capacitor charging constant current circuit 110 adjusts a current to a constant current by using the charging current control transistor 112. It should be noted that if the fourth LED current control transistor 24B controls a total current of the LED portion 10 and capacitor 111 charging current, it substitutes the function of the capacitor charging constant current circuit 110. In that case, the capacitor charging constant current circuit 110 can be omitted. (Operation for Charging Capacitor 111)

Figure 9:
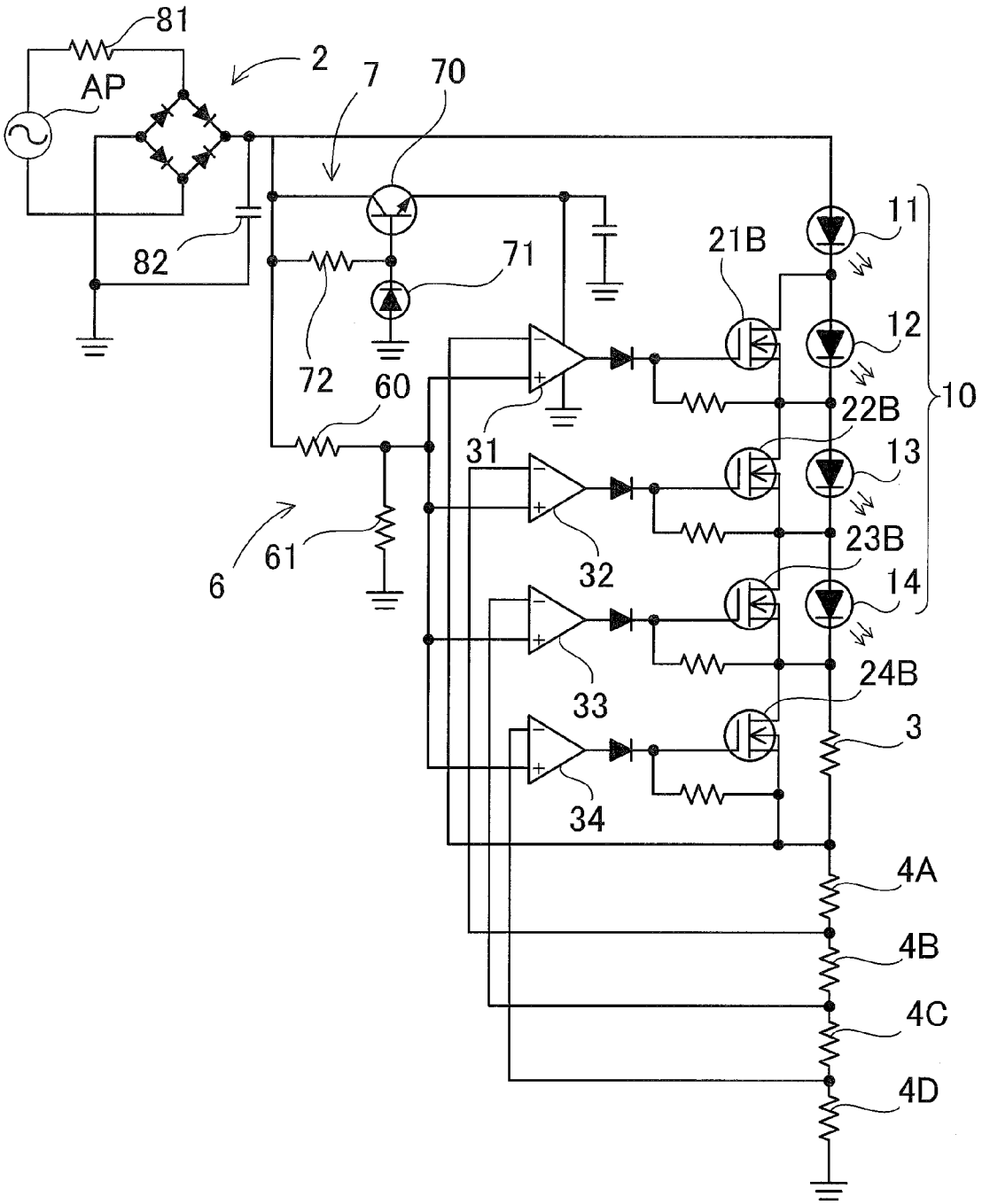
FIG. 9 RELATED ART
FIG. 9 is a circuit diagram showing another light-emitting diode driving apparatus which has been developed by the applicant.
Figure 10:
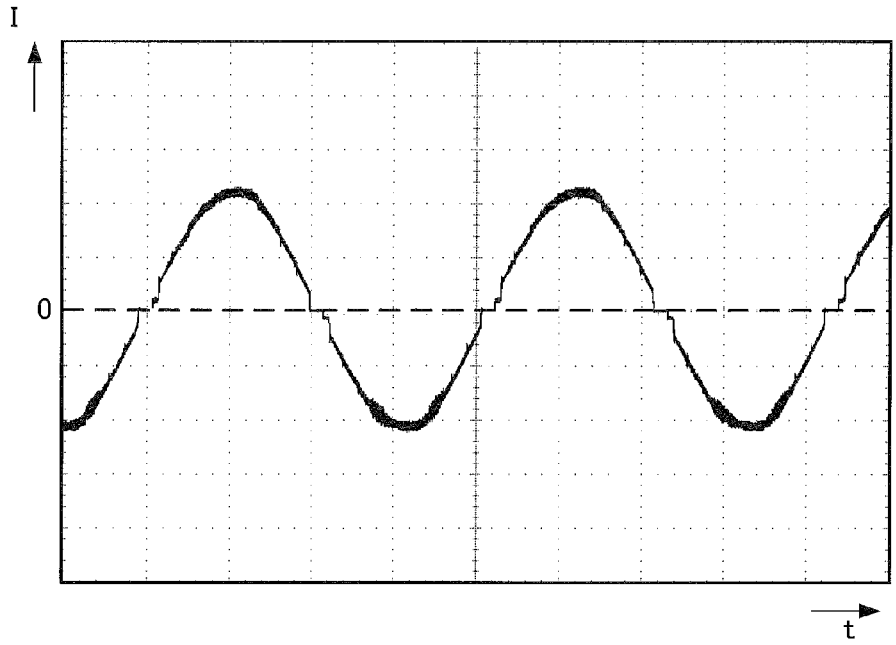
FIG. 10 RELATED ART
FIG. 10 is a graph showing an input current waveform of the light-emitting diode driving apparatus shown in FIG. 9.
Figure 11:
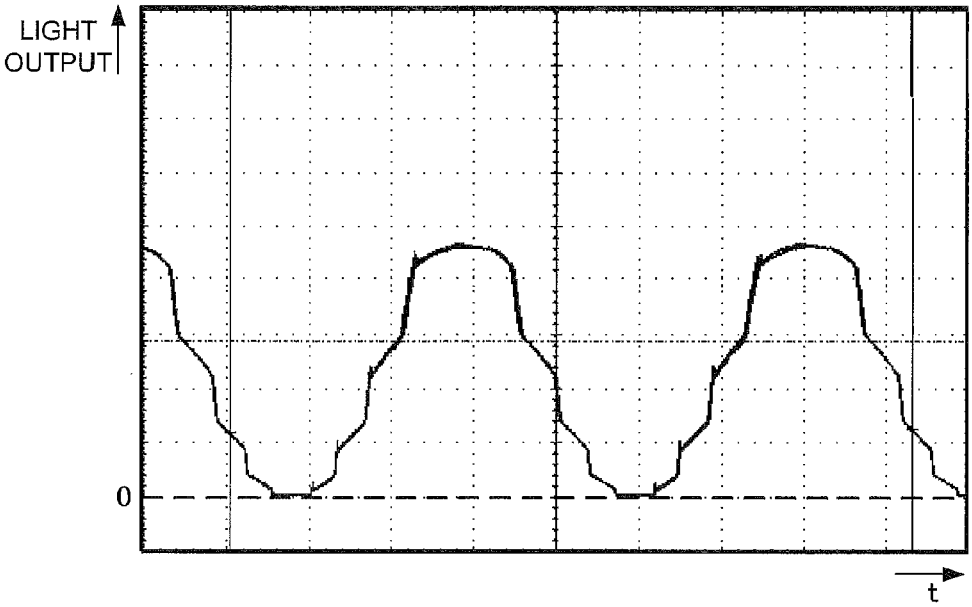
FIG. 11 RELATED ART
FIG. 11 is a graph showing a light output waveform of the light-emitting diode driving apparatus shown in FIG. 9.

A current waveform of the light-emitting diode driving apparatus shown in FIG. 2 is the same as a current waveform shown in FIG. 10. The capacitor 111 is charged from a power supply line through the capacitor 111, the charging current control transistor 112, the charging current detection resistor 115, the charging diode 116, a fourth backflow prevention diode 124, and the forth current control FET 24. A charging current is adjusted at a constant current by the charging current control transistor 112 of the capacitor charging constant current circuit 110 as discussed above. This charging current is adjusted smaller than a current controlled by the fourth current control FET 24. This charging current is superimposed on the LED current which flows in the LED portion 10. The fourth current control FET 24 adjusts this charging current so that the superimposed current has a sine waveform. Thus, the capacitor 111 can be charged without affecting the harmonic distortion suppression function provided by the exemplary circuit of FIG. 9.

The amount of LED current is reduced by the amount of capacitor charging current in the period where the capacitor is charged. In the exemplary circuit of FIG. 9, the fourth current control FET 24 controls a sine wave current in the period where all of the LEDs in the first to fourth LED sections 11 to 14 are brought ON, in other words, in the period where the power supply voltage is brought near its peak voltage. In this period, the light output also brought to its peak output. If the LED current can be reduced in this period, the maximum light output can be suppressed. As a result, it is possible to reduce the crest factor. To achieve this, the capacitor 111 is charged in this period so that the maximum light output is suppressed. The electric power is stored in the capacitor, and is then discharged when the power supply voltage is low so that light output is provided. In this case, it is possible to provide a synergistic effect in crest factor improvement.

The maximum period for charging the capacitor corresponds to the operation period of the fourth current control FET 24. In the case where the capacitor is continuously charged during this operation period, the charging constant current setting can be increased/reduced for proper adjustment.

(Operation for Discharging Capacitor 111)

The operation for discharging capacitor 111 is now described. In the light-emitting diode driving apparatus shown in FIG. 2, the discharging circuit for discharging the capacitor 111 includes the LED portion 10 of the first to fourth LED sections 11 to 14, and the discharging diode 117. Thus, although all of the LED sections are included in the discharging circuit, the discharging current does not flow in a sine wave multi-stage driving circuit. Accordingly, the discharging current does not affect the operation of the sine wave multi-stage driving circuit.

Figure 3:
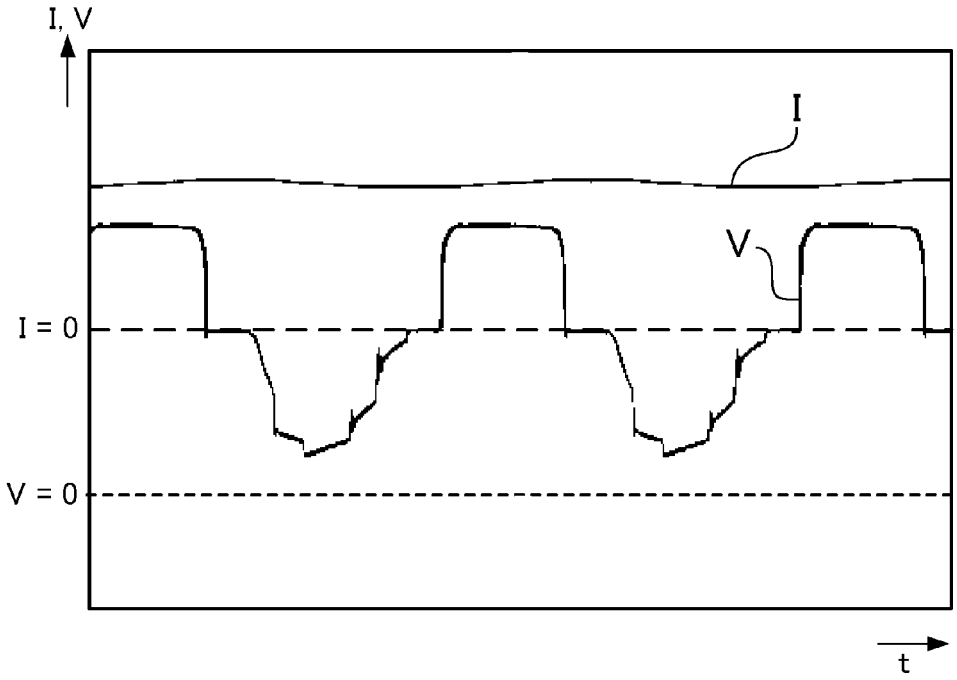
FIG. 3 is a graph showing a capacitor charging/discharging current and a voltage waveform of the light-emitting diode driving apparatus according to the first embodiment.

FIG. 3 shows a capacitor charging/discharging current and a capacitor charging/discharging voltage waveform. In this figure, the capacitor charging/discharging current and the capacitor charging/discharging voltage waveform are shown by V and I, respectively. The terminal voltage of the capacitor will be charged to a voltage substantially equal to an LED terminal voltage $V_{fa}$ which corresponds to an LED current when all of the LED sections are brought ON, in other words, corresponds to a current $I_{fa}$ which is obtained by subtracting a capacitor charging current from a control current controlled (adjusted) by the fourth current control FET 24. For this reason, although a discharging current from the capacitor is not adjusted at a constant current by constant-current control operation, the discharging current will be limited by the LED terminal voltage $V_{fa}$. As a result, a discharging current larger than $I_{fa}$ will not flow.

When the capacitor stops being charged, the charging current stops flowing. Accordingly, immediately after the capacitor stops being charged, the LED driving current is increased so that the terminal voltages of the LEDs correspondingly rise. As a result, the capacitor will not be discharged immediately after the capacitor stops being charged. After that, the power supply voltage further decreases so that the sine wave multi-stage driving circuit will start driving two groups of the first and second LED sections 11 and 12 at a constant current (the third and fourth LED sections 13 and 14 are brought OFF in the sine wave multi-stage driving circuit). In this control transition, the capacitor terminal voltage will exceed the LED terminal voltage so that the capacitor will start being discharged. This discharging current is superimposed on the sine wave driving current shown in FIG. 9. The superimposed current flows in LEDs. Accordingly, the LED terminal voltages rise so that the discharging current is suppressed. Therefore, an excess amount of current will not flow into LEDs. As the power supply voltage decreases, the number of the LED sections will be reduced which are driven by the sine wave multi-stage driving circuit. Accordingly, the LED terminal voltage variation caused by the driving current will also decrease.

Thus, the LED terminal voltage is increased/reduced in accordance with the increase/reduction of driving current. That is, the terminal voltage of the LED section will be higher when being driven by the multi-stage driving circuit than when not being driven. For this reason, the LED terminal voltage will be higher as the number of LED sections is increased which are driven by the multi-stage driving circuit. As a result, in the period where the LED terminal voltage exceeds the capacitor terminal voltage, the capacitor 111 will not be discharged. On the other hand, a current branches out the capacitor 111 side and the multi-stage driving circuit side so that the capacitor 111 is charged with a branched current. For this reason, the LED driving current in this case is $I_{fa}$ which will be smaller than the case where the capacitor charging constant current circuit 110 is not provided. That is, even after the capacitor is fully charged, the terminal voltage of the capacitor is a voltage $V_{fa}$, which can apply a current of up to $I_{fa}$ to all of the LED sections when the capacitor is discharged at the maximum. As the power supply voltage decreases, when the number of the LED sections is reduced which are driven by the multi-stage driving circuit, the LED terminal voltage will decrease so that the capacitor 111 will start being discharged. The LED terminal voltage is reduced as the number of LED sections is reduced which are driven by the multi-stage driving circuit so that the capacitor 111 will be discharged at higher current. However, even in this case, this discharging current will not exceed the maximum LED driving current $I_{fa}$ as discussed above.

The capacitor 111 is thus discharged in accordance with LED section driving operation. As a result, the LED sections can be brought ON even in the period where the LED sections are brought OFF by the sine wave multi-stage driving circuit as shown in FIG. 9. Also, the capacitor is discharged regardless of the sine wave multi-stage driving circuit, in other words, without affecting the harmonic distortion suppressing effect and the high power factor. For this reason, the crest factor of light output can be extremely improved since the light OFF period can be reduced by the additionally-provided sine wave multi-stage driving circuit without affecting the harmonic distortion suppressing effect and the high power factor.

Figure 4:
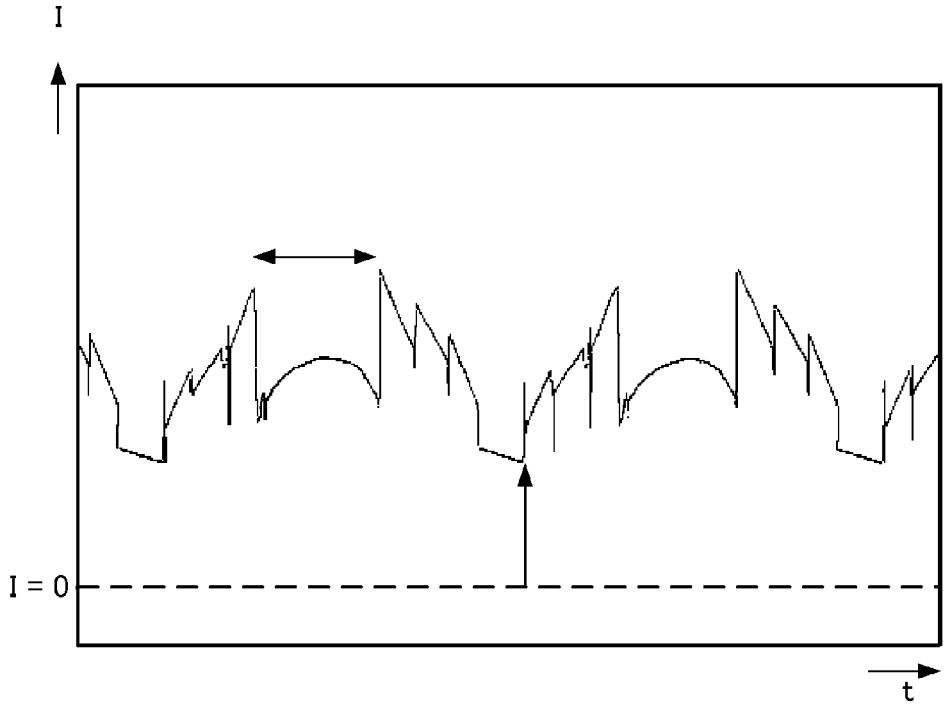
FIG. 4 is a graph showing a current waveform in a first LED section of the light-emitting diode driving apparatus according to the first embodiment.
Figure 12:
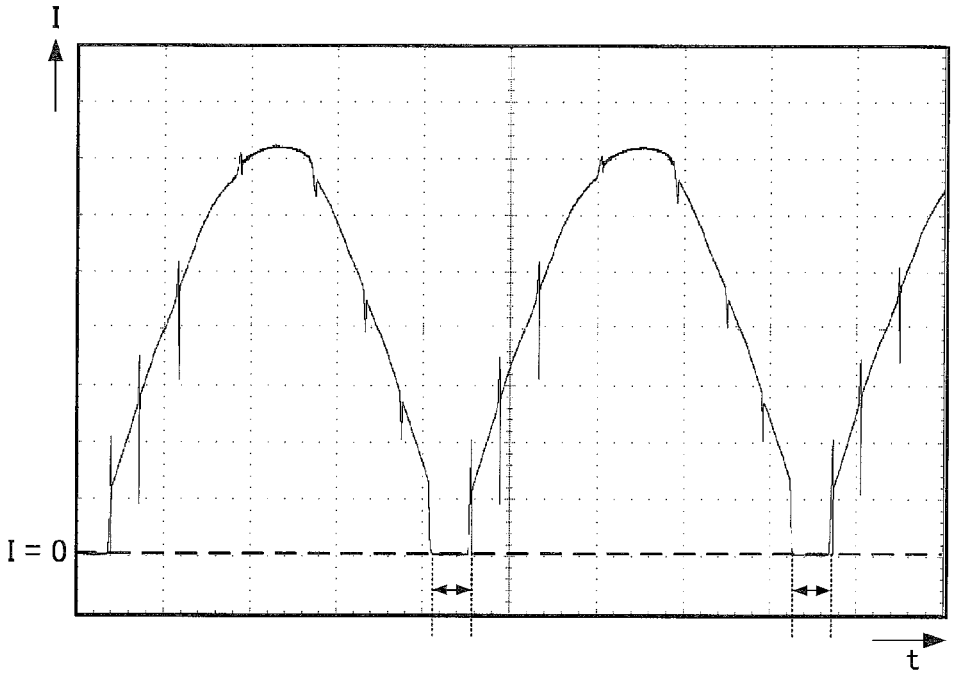
FIG. 12 RELATED ART
FIG. 12 is a graph showing a current waveform in a first LED section of the light-emitting diode driving apparatus shown in FIG. 9.

FIG. 4 shows the current waveform of the first LED section in the light-emitting diode driving apparatus according to the first embodiment. For comparison, FIG. 12 shows the current waveform of a first LED section in a light-emitting diode driving apparatus shown in FIG. 9 which has been developed by the applicant. In the case of the construction shown in FIG. 9, the first LED section is brought OFF in the period shown by the arrow in FIG. 12. In addition, in this case, the driving waveform of the first LED section has a waveform substantially close to sine wave. Contrary to this, according to the first embodiment, as seen from FIG. 4, the capacitor is charged so that the LED current is reduced in the period where the power supply voltage is brought near to its peak (period shown by the horizontal arrow in FIG. 4), while the capacitor discharging current is increased with the reduction of the current in the LED section driven by the sine wave multi-stage driving circuit (shown by the vertical arrow in FIG. 4). Accordingly, the first LED section can be kept ON to provide light output even in the period where the first LED section is brought ON in conventional light-emitting diode driving apparatuses. As a result, it can be seen that the period is eliminated where the LED sections are completely brought OFF. Since the reduced amount in the peak period of current is thus used in the period where the LED sections are brought OFF in conventional light-emitting diode driving apparatuses, it is possible to provide high quality LED section light emission with reduced flicker with the light amount being smoothed.

Figure 5:
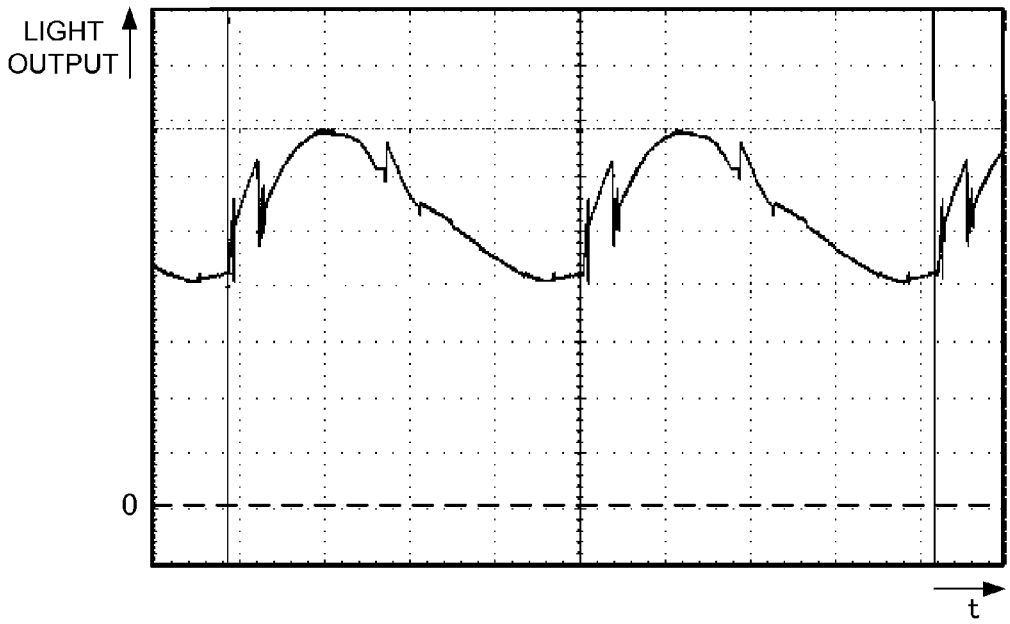
FIG. 5 is a graph showing a waveform of the light output measured in the light-emitting diode driving apparatus according to the first embodiment.
Figure 6:
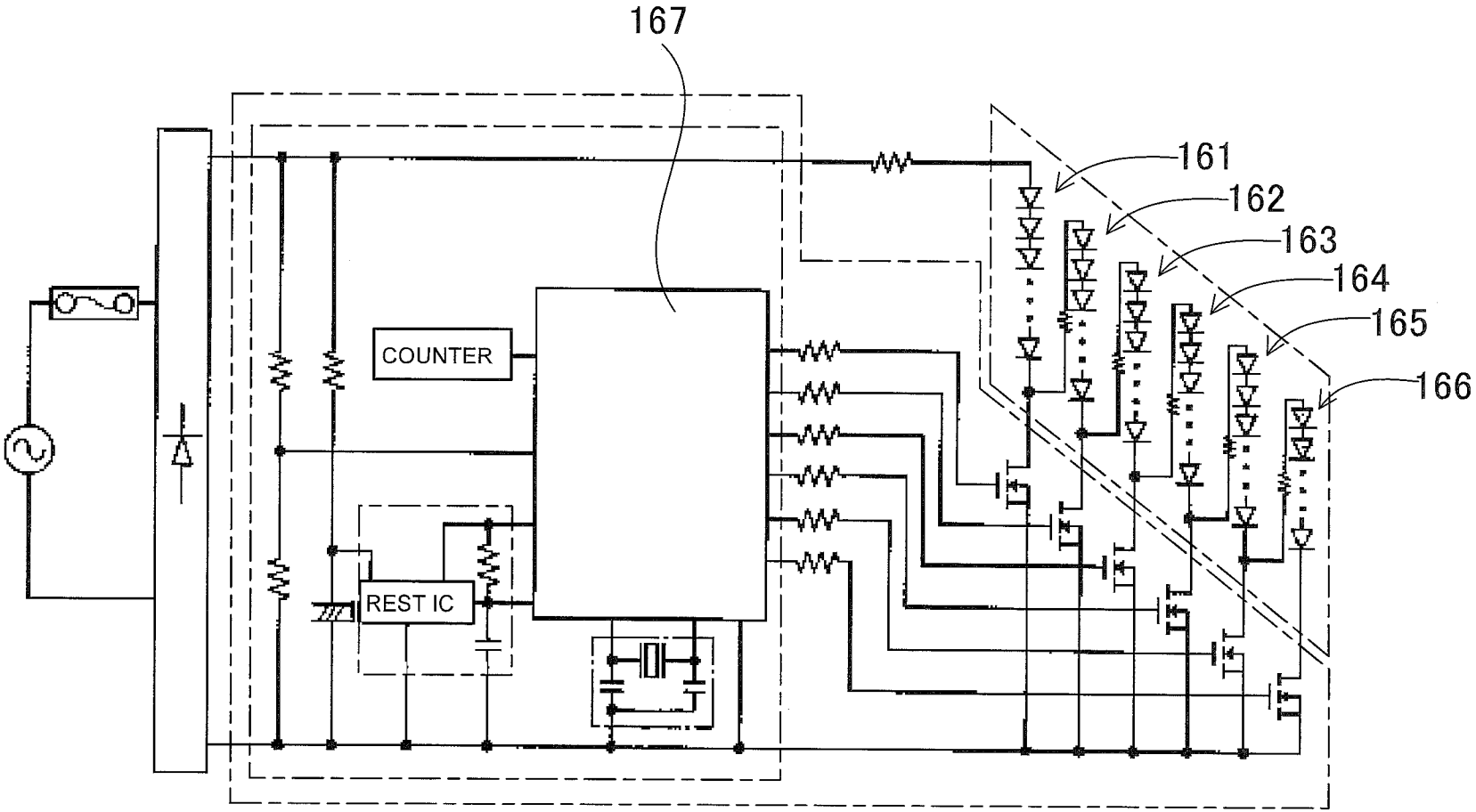
PRIOR ART FIG. 6
FIG. 6 is a circuit diagram showing a conventional LED driving circuit which uses a microcomputer.
Figure 7:
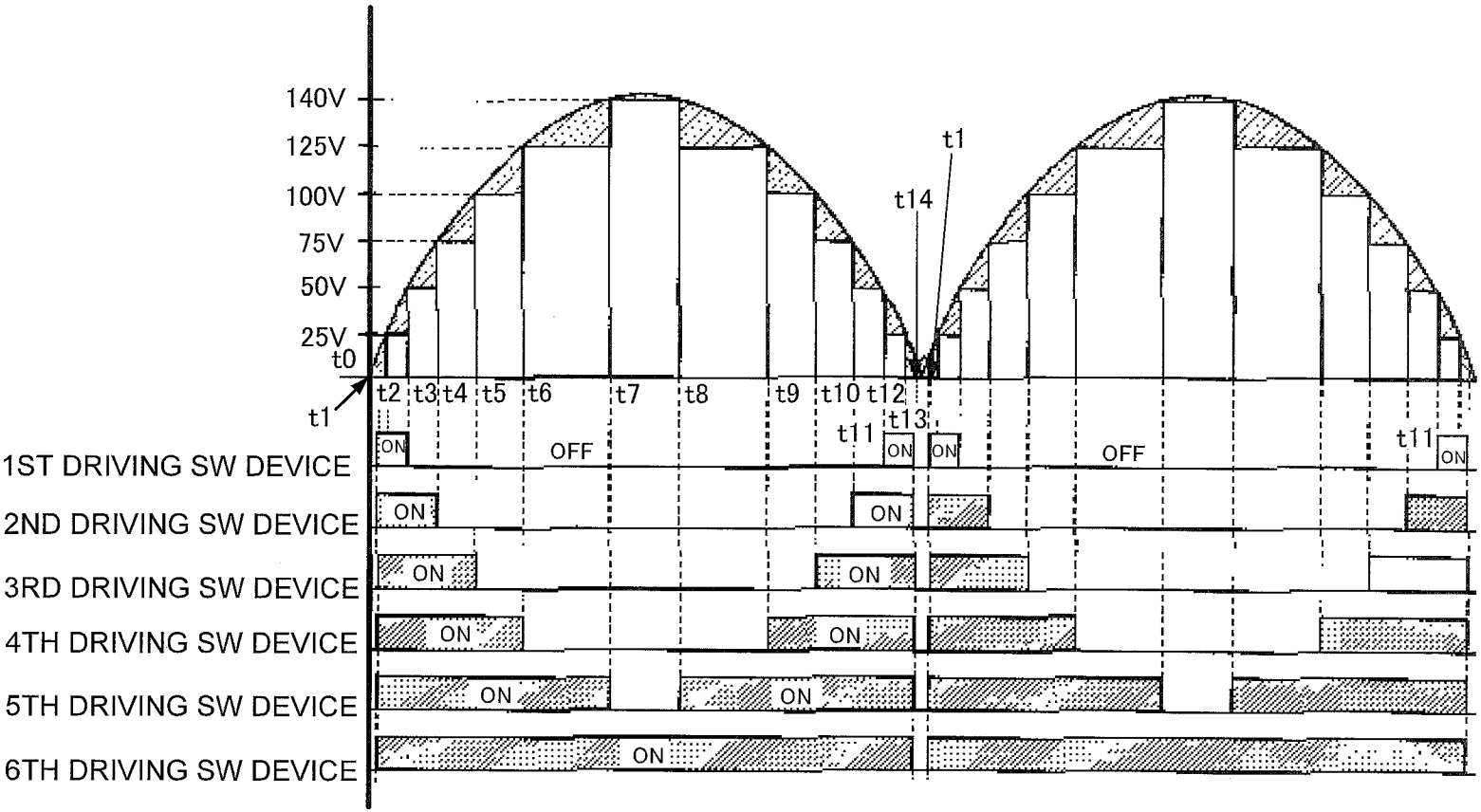
FIG. 7 PRIOR ART
FIG. 7 is a timing chart showing operation of the LED driving circuit shown in FIG. 6.

FIG. 5 is a graph showing a waveform of the light output measured in the light-emitting diode driving apparatus according to the first embodiment. As seen from this graph, the ratio of the smallest light output can be suppressed to about 60% relative to the peak light output. The crest factor in the first embodiment can be 1.2, which is better than the crest factor of the fluorescent light. Therefore, it can be confirmed that the light emission quality is improved much.

According to this construction, although the capacitor 111 with a large capacitance is provided, a large amount of inrush current can be prevented by the constant-current charging circuit which is additionally provided to the capacitor 111. Since the both ends of the capacitor are connected to the both ends of the LED portion, the terminal voltage variation due to the charging/discharging operation can be suppressed to several volts as seen from FIG. 3. As a result, it is possible to reduce the loss of the charging constant current circuit very much. In addition, since capacitor charging current is controlled by the constant current circuit, the capacitor ripple current is very small as compared with quick charge operation. For this reason, although it is said that aluminum electrolytic capacitors have shorter life as compared with LED devices, even in the case where an aluminum electrolytic capacitor is used, it is possible to surely provide a light-emitting diode driving apparatus with long life. Therefore, it is possible to improve the quality and reliability of the light-emitting diode driving apparatus.

INDUSTRIAL APPLICABILITY

The aforementioned light-emitting diode driving apparatus includes LED devices. The LED devices and the driving circuit for driving the LED devices can be mounted on a common circuit board. This light-emitting diode driving apparatus can be used as a lighting apparatus driven by AC commercial power for home use.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2011-116,390 filed in Japan on May 24, 2011, the content of which is incorporated herein by reference.

What is claimed is:

1. A light-emitting diode driving apparatus comprising:

a rectifying circuit that can be connected to AC power supply and rectifies an AC voltage of the AC power supply to provide a rectified voltage;

an LED portion that includes first and second LED sections serially connected to the output side of said rectifying circuit, each of the first and second LED sections including at least one LED device;

a third LED section that includes at least one LED device serially connected to said second LED section;

an LED driving portion that controls a current flowing in said LED portion;

a charging/discharging capacitor that is connected in parallel to said LED portion;

a capacitor charging path that is connected to said charging/discharging capacitor whereby charging said charging/discharging capacitor;

a capacitor discharging path that is connected to said charging/discharging capacitor whereby discharging said charging/discharging capacitor;

a capacitor charging constant current portion that is connected on said capacitor charging path and adjusts a capacitor charging current to a constant current;

a first portion that is connected in parallel to said second LED section, and controls the flowing current amount in said first LED section;

a second portion that is connected in parallel to said third LED section, and controls the flowing current amount in said first and second LED sections;

a fourth portion that is connected serially to said third LED section, and controls the flowing current amount in said first, second and third LED sections;

a first current control portion that controls said first portion;

a second current control portion that controls said second portion;

a fourth current control portion that controls said fourth portion; and a current detection portion that detects a current detection signal based on the amount of a current flowing in an output line serially connected from said first LED section to said third LED section, wherein when the rectified voltage applied to said LED portion becomes high, said charging/discharging capacitor is charged with the charging current through said charging path, and when the rectified voltage applied to said LED portion becomes low, said charging/discharging capacitor is discharged at a discharging current through said discharging path so that the discharging current is applied to said LED portion.

2. The light-emitting diode driving apparatus according to claim 1 further comprising a charging diode that is connected on said capacitor charging path and allows the charging current to flow whereby charging said charging/discharging capacitor, and a discharging diode that is connected on said capacitor discharging path and allows the discharging current to flow whereby discharging said charging/discharging, capacitor.

3. The light-emitting diode driving apparatus according to claim 1, wherein said capacitor charging constant current portion includes a plurality of transistors.

4. The light-emitting diode driving apparatus according to claim 1 further comprising a harmonic suppression signal providing portion that provides a harmonic suppression signal voltage based on the rectified voltage provided from said rectifying circuit, wherein said first, second and fourth current control portions compare the current detection signal detected by said current detection portion with the harmonic suppression signal voltage provided by said harmonic suppression signal providing portion, and control said first, second and fourth portions based on the comparison result whereby suppressing harmonic components.

5. The light-emitting diode driving apparatus according to claim 4 further comprising a fourth LED section that includes at least one LED device serially connected to said third LED section, a third portion that is connected in parallel said fourth LED section, and controls the flowing current amount in said first, second and third LED sections, and a third current control portion that controls said third portion, wherein said fourth portion controls the flowing current amount in said first, second, third and fourth LED sections.

* * * * *